United States Patent [19]

Snyder

[11] 4,228,569

[45] Oct. 21, 1980

[54] IDENTIFICATION BADGE CLIP

[75] Inventor: George R. Snyder, Woodbridge, Conn.

[73] Assignee: Risdon Corporation, Naugatuck, Conn.

[21] Appl. No.: 2,666

[22] Filed: Jan. 11, 1979

[51] Int. Cl.[2] ..... A44B 21/00

[52] U.S. Cl. ..... 24/252 R; 24/67.3; 24/137 R; 24/259 R

[58] Field of Search ..... 24/252 R, 137 R, 259 R, 24/67.3, 67.5

[56] References Cited

U.S. PATENT DOCUMENTS

| | | | |
|---|---|---|---|
| 206,896 | 8/1878 | Porter | 24/252 R |
| 1,176,586 | 3/1916 | Megahan | 24/252 R |

*Primary Examiner*—Kenneth Downey

[57] ABSTRACT

A two-piece clip comprises a rigid base member having upward arms embracing a Z-shaped spring member. A fulcrum is provided where the arms meet the outer run of the spring member. Jaws are provided on the adjacent ends of the respective members.

3 Claims, 6 Drawing Figures

IDENTIFICATION BADGE CLIP

BACKGROUND OF THE INVENTION

1. Field of the Invention

This invention relates to an identification badge clip which is secured to the badge of a workman, for instance, and which provides means for attaching the assembly to his clothing.

2. Description of the Prior Art

In the prior art, there are a number of clips, usually of several parts and often with pintle-type pivot means. The assembly of such clips has consumed considerable time and has often required the bending of parts. Often, the clips have been of three or four parts and have involved a wire axis and coil spring which has had to be compressed manually in the assembly operation. Such a clip has involved thus the manufacture and storage of a plurality of parts.

SUMMARY OF THE INVENTION

Under the present invention, a clip is provided which is surprisingly simple. It comprises two parts, one a hardened base member, the other a resilient Z-shaped member which fits into the base member, the two members together offering a pair of jaws.

BRIEF DESCRIPTION OF THE DRAWINGS

Further objects and features of the invention will be apparent from a study of the following specification, including drawings, all of which disclose a non-limiting form of the invention. In the drawings.

DESCRIPTION OF THE PREFERRED EMBODIMENT

Figure 1:
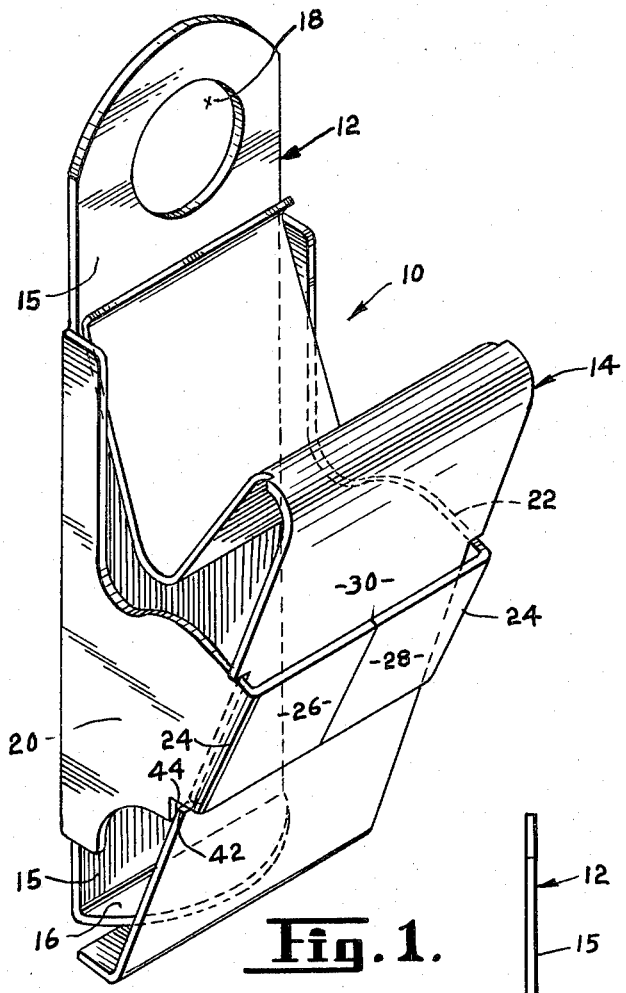
FIG. 1 is a perspective view of a clip embodying the invention.
Figure 2:
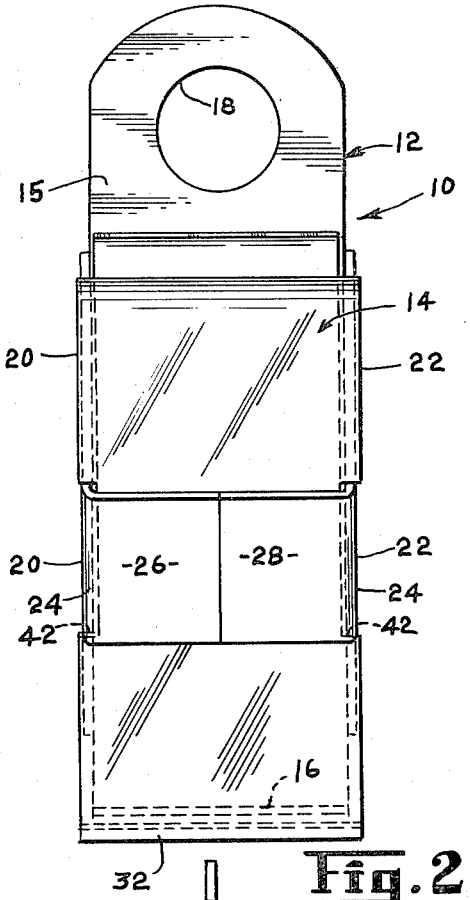
FIG. 2 is a front view.
Figure 3:
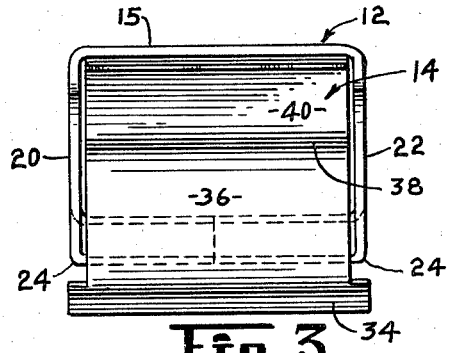
FIG. 3 is a top view.
Figure 4:
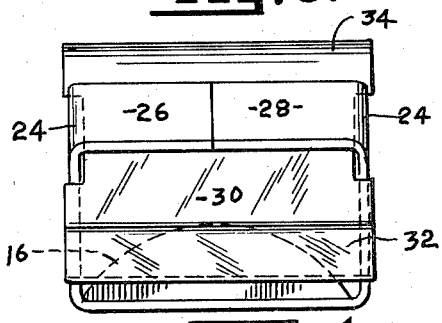
FIG. 4 is a bottom view.
Figure 5:
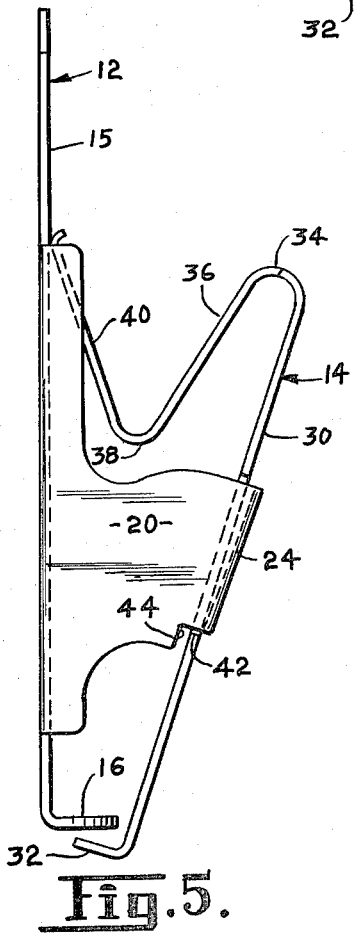
FIG. 5 is a left side view.
Figure 6:
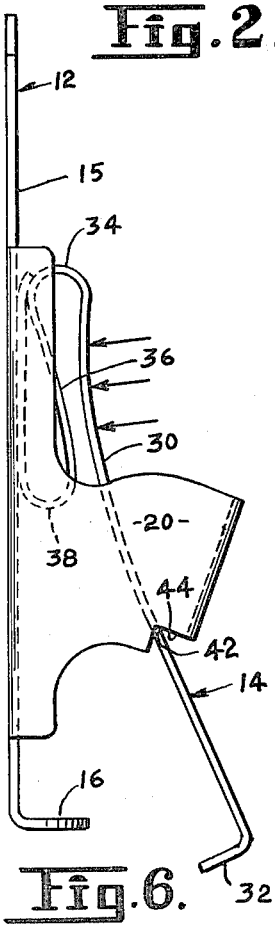
FIG. 6 shows the clip in FIG. 5 in open condition.

A clip embodying the invention is generally designated 10 in FIG. 1. It comprises a base member 12 and a Z-shaped spring member 14.

Base member 12 is preferably of sheet metal and is rigid. It comprises a flat strip 15 which is turned up at one end to provide a jaw 16. Adjacent the other end, the strip may be apertured as at 18 for riveting to the badge. A pair of arms 20 and 22 extend up from the sides of the strip 15 and extend adjacent the strip along substantially more than half of the length thereof to give the strip rigidity. As shown, the arms narrow as the distance out from the strip 15 increases.

At a point 24 out from the strip, the arms are each bent inward to form flanges 26, 28 which meet.

Preferably, the base member 12 is hardened as by heat treating so that it is rigid, although it should be clear that the width of the arms at their juncture with strip 15 gives the base member some rigidity without heat treating.

The second member is the Z-shaped spring which is made of resilient metal strip and is disposed within the embrace of the arms 20, 22. It includes an outer run 30 which is adjacent the flanges 26, 28. The lower end of the outer run 30 is formed with a second jaw 32 bent downwardly toward the base member 12. The Z-shaped member is doubled back at 34 to an intermediate run 36 and again doubled back as at 38 in an inner end run 40, a portion of which engages the strip 15 as shown.

The outer end run 30 is enlarged at its end adjacent the second jaw 32 to provide shoulders 42 which engage the arms 20, 22 preferably in notches 44 adjacent the bend points 24. This provides a fulcrum or anchor for the pivot as the clip is operated.

In operation, thumb pressure, for instance, is applied to the outer end run 30 at its exposed part more remote from the jaw 32. This works against the natural resilience of the Z-shaped member which yields mostly at its points of bend 34, 38. The inward movement of said more remote portion of the run 30 causes the outward movement of the portion of the run 30 adjacent the jaw due to the fulcrum effect at 42, 44. Release of pressure on the more remote portion causes the jaws, conversely, to close.

The material of the two members is preferably metal. The Z-shaped member is preferably a spring steel.

While the invention has been disclosed in a single embodiment, it is capable of many variations and the invention is thus not limited but may be described in the following claim language including equivalents thereof.

I claim:

1. An identification badge clip comprising:

(a) a hardened sheet metal base member including a flat strip having a first jaw bent up substantially at right angles at one end and a pair of aligned arms extending up from opposite sides of the strip, and being formed with aligned notches spaced up from the strip, the distal ends of the arms each being bent at a point spaced outward of the strip from the notches and extending inward in flanges toward each other, and (b) a Z-shaped member of resilient metal strip disposed within the embrace of said arms to hold the base member and strip together as an assembly and including an inner end run, an intermediate run and an outer end run engaging the flanges, the outer end run having a second jaw at its free end bent down substantially at right angles and aligned with the first jaw, the inner end run contacting the base member, the Z-shaped member being biased to close the jaws, the outer end run being enlarged between the second jaw and the engagement of the lastmentioned run with the arms and the enlargement presenting shoulders which engage the arms in the notches, whereby the notches present an outward-facing fulcrum so that downward pressure on the outer end run adjacent its non-free end opens the jaws.

2. An identification badge clip as claimed in claim 1 wherein the flanges are angled toward the end of the first jaw member.

3. An identification badge clip as claimed in claim 1 wherein the arms extend in their width for at least one-half the length of the strip at their juncture with the strip.

* * * * *